United States Patent [19]

Usui

[11] 4,448,015

[45] May 15, 1984

[54] WINDING METHOD AND APPARATUS

[76] Inventor: Fumio Usui, 441 Shimoasao, Asao-ku, Kawasaki-shi, Kanagawa, 215, Japan

[21] Appl. No.: 405,953

[22] PCT Filed: Dec. 28, 1981

[86] PCT No.: PCT/JP81/00419

§ 371 Date: Aug. 5, 1982

§ 102(e) Date: Aug. 5, 1982

[87] PCT Pub. No.: WO82/02377

PCT Pub. Date: Jul. 22, 1982

[30] Foreign Application Priority Data

Jan. 13, 1981 [JP] Japan ..... 56-3511

[51] Int. Cl.[3] ..... D07B 7/14

[52] U.S. Cl. ..... 57/3; 57/6; 57/18; 57/293

[58] Field of Search ..... 57/3, 6, 9, 10, 11, 57/18, 293, 294

[56] References Cited

U.S. PATENT DOCUMENTS

| | | | |
|---|---|---|---|
| 515,597 | 2/1894 | Lyon | 57/10 |
| 2,153,072 | 4/1939 | Bookout et al. | 57/18 X |
| 3,284,995 | 11/1966 | Haight | 57/3 |
| 3,291,403 | 12/1966 | Montgomery | 57/18 X |
| 3,729,913 | 5/1973 | Wray | 57/18 X |
| 3,940,073 | 2/1976 | Haeusler et al. | 57/10 X |

*Primary Examiner*—Donald Watkins

*Attorney, Agent, or Firm*—Wenderoth, Lind & Ponack

[57] ABSTRACT

A linear material 41 is once wound on a winding drum 3, and then wound on a core bar 1 by a winding disk 2. The winding disk 2 periodically reverses the direction of rotation.

9 Claims, 14 Drawing Figures

WINDING METHOD AND APPARATUS

DESCRIPTION

TECHNICAL FIELD

The present invention relates to a method and an apparatus for winding a linear material.

BACKGROUND ART

The term "linear material" as used herein and in the appended claims is to be understood to mean any such materials as vegetable fiber, animal fiber, mineral fiber, synthetic fiber, metal wire, and the like. In the manufacture of composite pipe material, bar material, and plate material, it has often been the practice heretofore to wind a linear material around a core bar, to impregnate the winding of the linear material with such material as synthetic resin, cement, molten metal, or the like, and to allow such material to harden.

In the heretofore employed winding process, the linear material was wound around the core bar either by rotating the core bar while fixing a reel on which the linear material was wound or by moving the reel about the fixed core bar. However, the conventional winding process described above had serious disadvantages such that:

(1) It was difficult to enlarge the equipment because either the reel or the core bar had to be rotated or moved about;

(2) A continuous operation over a long time was difficult because exchange of the reel and extension of the core bar were necessary;

(3) It was difficult to wind a number of linear materials simultaneously; and (4) Since the rotating and moving means was relatively complicated in construction and large in size, it was difficult to add thereto apparatuses to perform other working processes simultaneously.

DISCLOSURE OF THE INVENTION

An object of the present invention is to remove the disadvantages of the conventional winding process and to provide a winding method and an apparatus therefor, which are economical and efficient.

The winding method according to the present invention comprises the steps of inserting a core bar through a winding drum and a winding disk for a coaxial and relative movement therewith; disposing a reel with a linear material wound therearound at a predetermined position; fixing a leading end of the linear material payed out from said reel at an arbitrary position on said core bar through a guide hole of said winding disk; rotating said winding disk in a first direction while moving said core bar in a predetermined direction, thereby winding the linear material around said core bar while winding the linear material around said winding drum; after a predetermined quantity of the linear material has been wound, binding a terminal end of the winding of the linear material on said core bar to fix it thereon; after said binding and fixing, rotating said winding disk in a second direction which is opposite to said first direction while moving said core bar in a predetermined direction, thereby winding the linear material around said core bar while unwinding the winding around the outer peripheral surface of said winding drum and rewinding it; after a predetermined quantity of the linear material has been wound, binding securely the terminal end of the winding of the linear material around said core bar; and repeating the winding and the secure binding of the linear material around said core bar at predetermined times.

The winding apparatus according to the present invention comprises a reel disposed at a predetermined position and wound therearound with a linear material; an elongated core bar of a predetermined sectional shape; a driving mechanism for moving said core bar in the longitudinal direction thereof at a predetermined speed; a winding disk supported coaxially and relatively movably with said core bar and having at least one guide hole; a driving mechanism for rotating said winding disk alternately in opposite directions with a predetermined period and at a predetermined speed; a winding drum disposed upstream of and adjacent to said winding disk with respect to the direction of movement of said core bar and supported coaxially and relatively movably with said core bar; and a binder disposed downstream of and adjacent to said winding disk with respect to the direction of movement of said core bar, for securely binding other linear material around said core bar with a predetermined period.

BEST MODE FOR CARRYING OUT THE INVENTION

Figure 1:
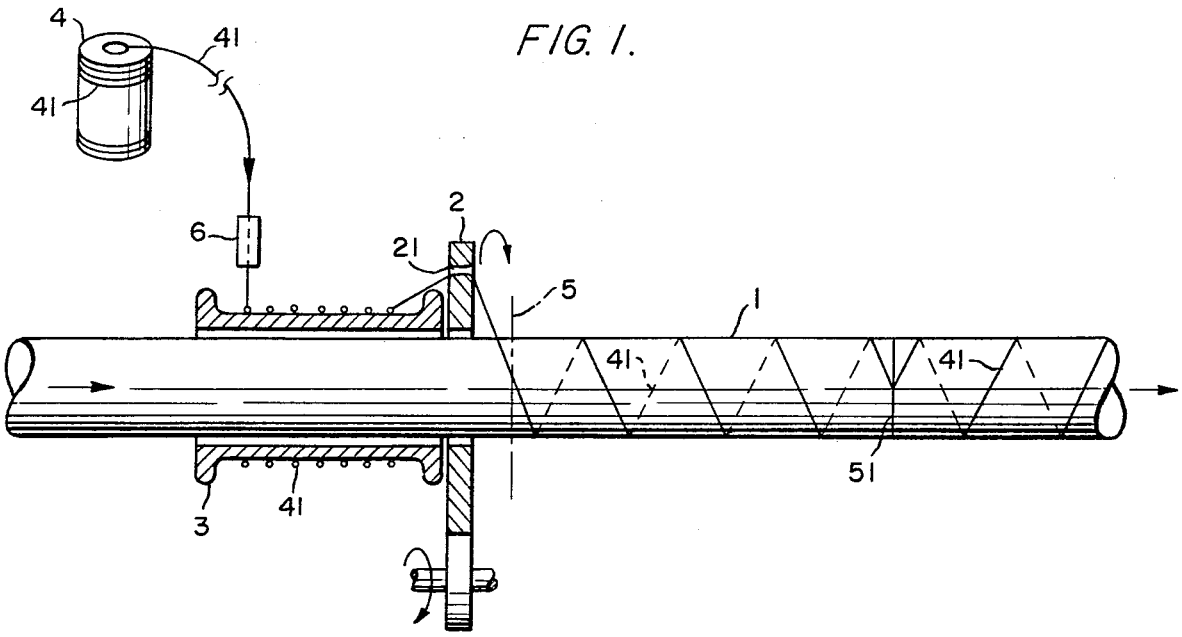
FIG. 1 is a schematic illustration of the principle of the method according to the present invention.

The principle of the method according to the present invention will now be described with reference to FIG. 1. In the method according to the present invention, a core bar 1, a winding disk 2 and a winding drum 3 are first prepared. Then, the core bar 1 is inserted coaxially through central holes of the winding disk 2 and the winding drum 3 and supported free from contact therewith. The core bar 1 is movable axially and the winding disk 2 is rotatable about the axis of the core bar 1. The winding disk 2 is provided with at least one guide hole 21 on the outer periphery thereof. A reel 4 having a linear material 41 wound therearound is located at a predetermined position. A binding position 5 is established at a position downstream of and adjacent to the winding disk 2 with respect to the direction of movement of the core bar 1.

Figure 2A:
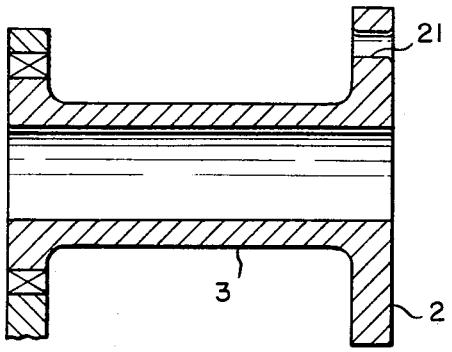
FIGS. 2A to 2C are sectional views showing relationships between the winding disk and the winding drum.
Figure 2B:
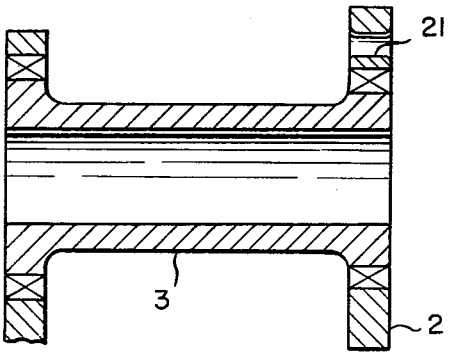
Figure 2C:
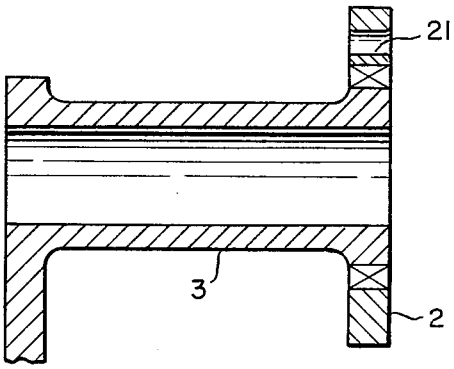

The relationship between the winding disk 2 and the winding drum 3 is as shown in FIGS. 2A to 2C, that is, the winding disk 2 and the winding drum 3 may take any of the three different constructions in which they are formed integrally (FIG. 2A), they are connected rotatably relative to each other (FIG. 2B), or the winding drum 3 is fixed while the winding disk 2 is supported rotatably therewith (FIG. 2C). The winding drum 3 is positioned upstream of and adjacent to the winding disk 2 with respect to the direction of movement of the core bar 1.

Figure 3:
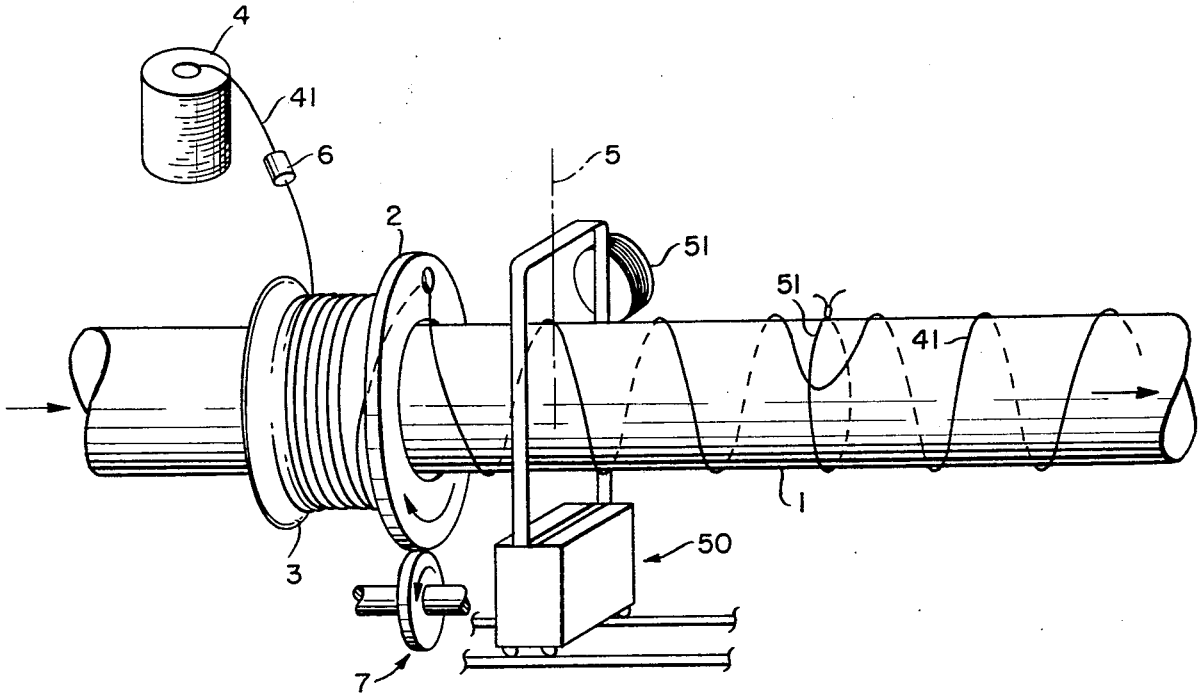
FIG. 3 is a schematic illustration of the principle of the apparatus according to the present invention.

At the binding position 5, the linear material 41 wound around the outer peripheral surface of the core bar 1 is bound and fixed by a linear material 51 manually or using a binder 50 (FIG. 3). The linear material 51 used for binding and fixing the linear material 41 is preferably of the equal quality to the linear material 41. The object of the binding and fixing is to prevent unwinding of the terminal end of the linear material 41 wound on the core bar 1 when the winding disk 2 is reversed in rotation as will be described hereinbelow. Accordingly, any other material such as tape, ring or clip may be used in place of the linear material 51.

After the preliminary stage has been finished in the manner described above, the linear material 41 is pulled out of the reel 4, passed through a suitable guide 6, wound around the winding drum 3 suitable times, passed through the guide hole 21 of the winding disk 2, and fixed at the leading end thereof to a suitable position of the outer peripheral surface of the core bar 1. Thereafter, the winding disk 2 is rotated in the predetermined direction while the core bar 1 is moved axially in the predetermined direction (for example, to the right in FIG. 1).

When the winding disk 2 is rotated in either direction in the state described above, the linear material 41 is wound on both of the winding drum 3 and the core bar 1. That is, as shown schematically in FIG. 1, the linear material 41 is firstly wound on the winding drum 3, slides thereon, passes through the guide hole 21 of the winding disk 2 and is wound on the core bar 1. The number of turns of the linear material 41 wound on the winding drum 3 is the same as the number of turns of the linear material wound on the core bar 1 except the number of turns thereof initially wound on the winding drum 3.

The winding pitch of the linear material 41 wound on the core bar 1 can be changed by controlling the speed of movement of the core bar 1 or the speed of rotation of the winding disk 2. In this manner, the linear material 41 can be wound on the core bar 1 in a rough pitch and on the winding drum 3 in a tight pitch.

When a predetermined quantity of the linear material 41 has been wound on the core bar 1 or on the winding drum 3, the terminal end of the winding on the core bar 1 is bound and fixed at the binding position 5 by the other linear material 51 manually or using the binder 50 so as to keep the terminal end of the winding from being unwound off the core bar 1.

After the binding and fixing operation, the winding disk 2 is rotated in the direction reverse to that in the preceding occasion. In the first half of the reverse rotation of the winding disk 2, the linear material, while being unwound from the winding on the winding drum 3, is wound on the core bar 1 in the direction reverse to that in the preceding occasion. In the second half of the reverse rotation of the winding disk 2, that is after the winding of the linear material has been unwound out from the winding drum 3, the linear material 41, while being wound on the winding drum 3 in the direction reverse to that in the preceding occasion, is continuously wound on the core bar 1.

When a predetermined quantity of the linear material 41 has been wound on the core bar 1 or on the winding drum 3, binding and fixing operation is performed as in the preceding occasion.

The winding operation shown schematically in FIG. 1 is performed by repeating sequentially the steps described above.

The reverse rotation of the winding disk 2 is performed preferably in synchronism with the binding and fixing operation. For carrying out the binding and fixing operation smoothly, the movement of the core bar 1 may be temporarily stopped during the binding and fixing operation or the binding position 5 may be shifted within a predetermined range in time with the speed of movement of the core bar 1.

In the winding process of the linear material 41, as described above, since the linear material 41 slides on the winding drum 3, it is preferred that the winding drum 3 is plated, attached thereon with a low-frictional material, or provided with idle rollers on the outer surface thereof for smooth sliding of the linear material thereon.

As explained with respect to FIG. 2, there are three different combinations between the winding disk 2 and the winding drum 3. There is no large difference in effect among these combinations. In the integral construction between the disk 2 and the drum 3 (FIG. 2A), the linear material winding operation is carried out smoothly because the winding of the linear material is formed from the side opposite to the disk 2. In the construction in which the disk 2 and the drum 3 are relatively rotatable (FIG. 2B), it is possible to apply a brake to the drum 3 during the reverse rotation of the disk 2 to prevent the winding from becoming loose. In the construction in which the winding drum 3 is fixed (FIG. 2C), winding and unwinding of the winding can be carried out relatively smoothly in the reverse rotation because the winding of the linear material is formed from the side of the winding disk 2.

By providing the winding disk 2 with a plurality of the guide holes 21, it is made possible to wind a plurality of pieces of the linear material 41 simultaneously on the core bar 1.

By the construction for continuous feeding of the core bar 1 (For example, Japanese Patent Public Disclosure No. 125772/79 Official Gazette), it is made possible to perform the winding operation continuously for a long time.

The sectional shape of the core bar 1 may be a circle, ellipse, polygon, flat figure, or any other shape.

The principle of the winding apparatus according to the present invention will now be described with reference to FIG. 3. The construction of FIG. 3 is substantially identical to that of FIG. 1. As shown in FIG. 3, the binder 50 is disposed at the binding position 5. The winding disk 2 is rotated alternately in normal and reverse directions with a predetermined period and at a predetermined speed by a driving mechanism 7. The core bar feeding mechanism may be of any conventional means using, for example, roller and will not need to be described further.

The binder 50 is satisfactory if it has the function to wind the linear material 51 on the outer peripheral surface of the core bar 1 once or twice and bind it. As the binder 50 having such function, a commercially available automatic packing machine may be utilized. Since such automatic packing machine is capable of high speed operation requiring only 2–5 seconds for one cycle of operation, it causes no particular hindrance to the binding operation during the ordinary winding. In order to achieve secure binding, however, it is preferable to stop the core bar 1 temporarily only during the binding or to move the binder 50 a predetermined distance in synchronism with the core bar 1.

The winding disk 2 and the winding drum 3 may be constructed in any of the relationships shown in FIGS. 2A to 2C, the concrete construction of which will be described in detail below.

Figure 4:
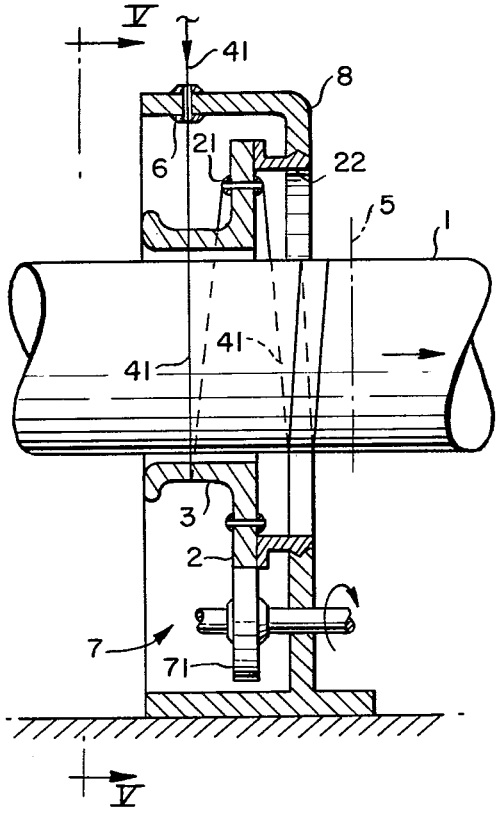
FIG. 4 is a sectional view of an embodiment of the winding apparatus according to the present invention.
Figure 5:
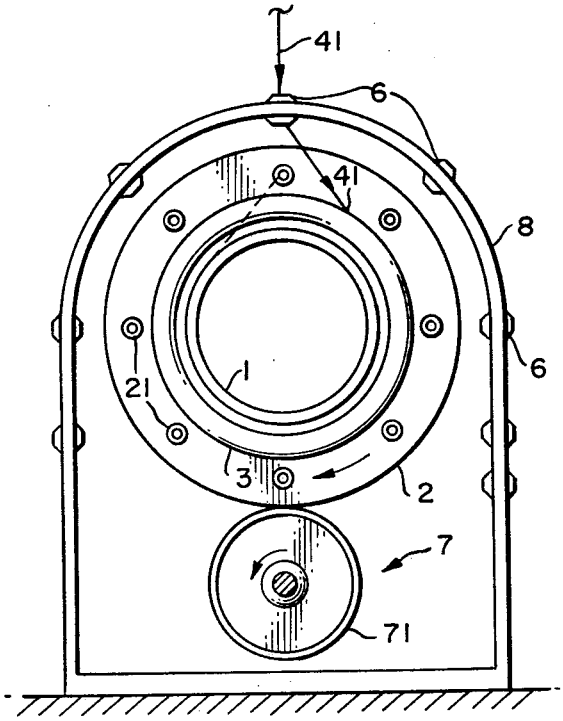
FIG. 5 is an elevation viewed from the line V—V of FIG. 4.

The embodiment shown in FIGS. 4 and 5 corresponds to the construction shown in FIG. 2A. That is, the winding disk 2 is formed integrally with the winding drum 3 and supported rotatably with respect to a support frame 8 by a slide ring 22. The core bar 1 is inserted through the central holes of the winding disk 2 and the winding drum 3 and is supported against contact therewith. A disk 71 of the driving mechanism 7 is in frictional contact with the outer peripheral surface of the winding disk 2.

The linear material 41 passes through any one of a plurality of guides 6 provided in the support frame 8, turns around the outer peripheral surface of the winding drum 3, passes through the guide hole 21 provided in the winding disk 2, and is fixed in the leading end thereof to an arbitrary position of the core bar 1.

The winding operation is the same as that described above in relation to FIG. 1.

Figure 6:
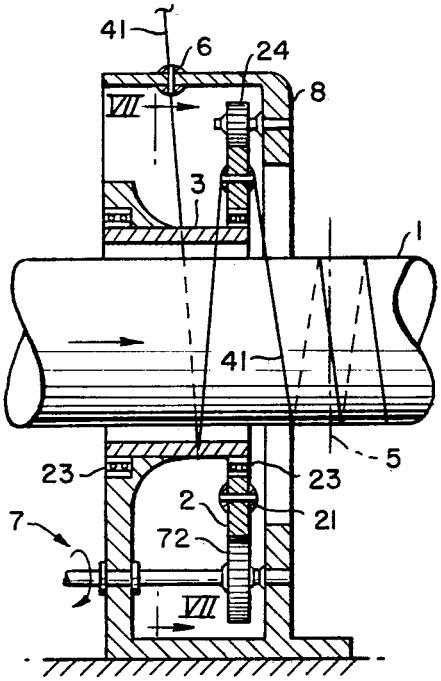
FIG. 6 is a view similar to FIG. 4, showing another embodiment.
Figure 7:
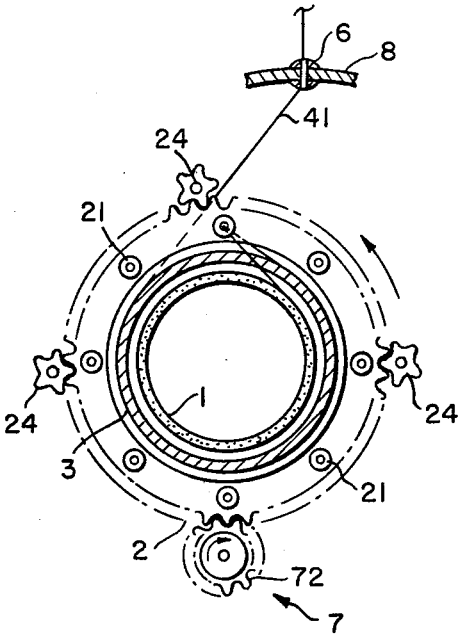
FIG. 7 is an elevation viewed from the line VII—VII of FIG. 6.

The embodiment shown in FIGS. 6 and 7 corresponds to the construction of FIG. 2B. The winding disk 2 and the winding drum 3 are connected relatively rotatably through conventional roller bearings 23. The winding drum 3 is supported rotatably with respect to the support frame 8 through the roller bearings 23. The winding disk 2 is serrated on the outer periphery thereof for engagement with idle gears 24 and with a driving gear 72 of the driving mechanism 7. The winding disk 2 is supported by the idle gears 24 rotatably at a predetermined position and is rotatably driven by the driving gear 72.

Figure 8:
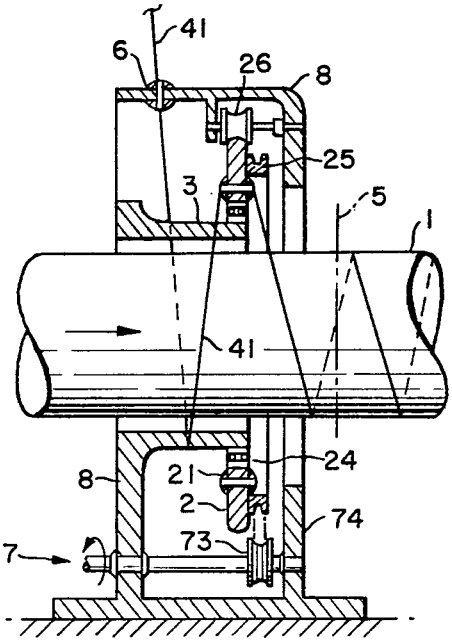
FIG. 8 is a view similar to FIG. 4, showing a further embodiment.

The embodiment shown in FIG. 8 corresponds to the construction of FIG. 2C. The winding disk 2 is connected rotatably with respect to the winding drum 3 through the roller bearings 24. A pulley 25 is fixed to a side of the winding disk 2 and is connected to a driving pulley 73 of the driving mechanism 7 through a belt 74. The winding disk 2 is supported rotatably at a predetermined position by a roller 26 and is rotatably driven by the driving pulley 73.

The system for rotatably driving the winding disk 2 is not specifically limited to the embodiments described above but may be interchanged as required.

Figure 9:
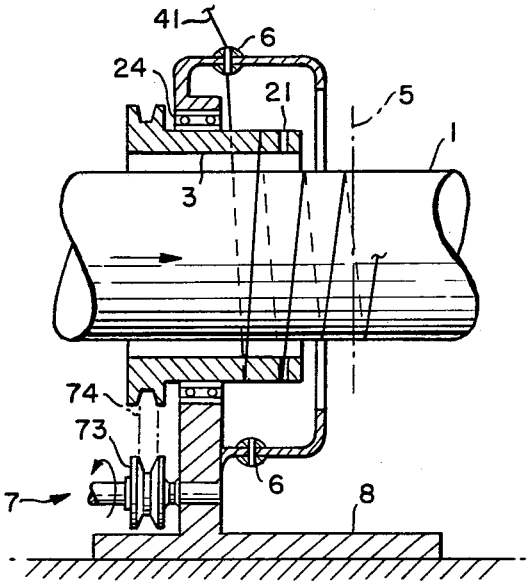
FIG. 9 is a view similar to FIG. 4, showing a still further embodiment.

In the case where the winding disk 2 and the winding drum 3 are formed integrally, the guide hole 21 may be provided directly at the forward end of the winding drum 3 as shown in FIG. 9, without forming the winding disk 2 specifically. By this construction, the winding angle of the winding on the core bar 1 can be reduced.

Figure 10:
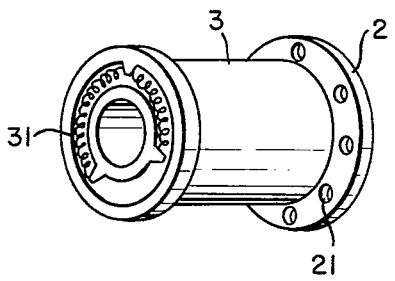
FIGS. 10 and 11 are perspective views showing other embodiments of the winding disk and the winding drum.

The winding sometimes becomes loose during reverse rotation of the winding disk 2. Accordingly, an example of the mechanism for preventing loosening of the winding is shown in FIG. 10. In this mechanism, the winding disk 2 and the winding drum 3 are connected relatively rotatably, and a pair of coil springs 31 are interposed between them so that a reaction force is transmitted to the winding drum 3 through the springs 31 during the reverse rotation of the winding disk 2.

Figure 11:
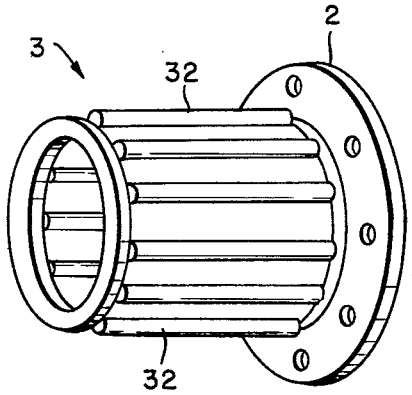

For smooth relative sliding between the winding drum 3 and the winding thereon, it is effective to attach rollers 32 rotatably along the outer peripheral surface of the winding drum 3 as shown in FIG. 11.

Figure 12:
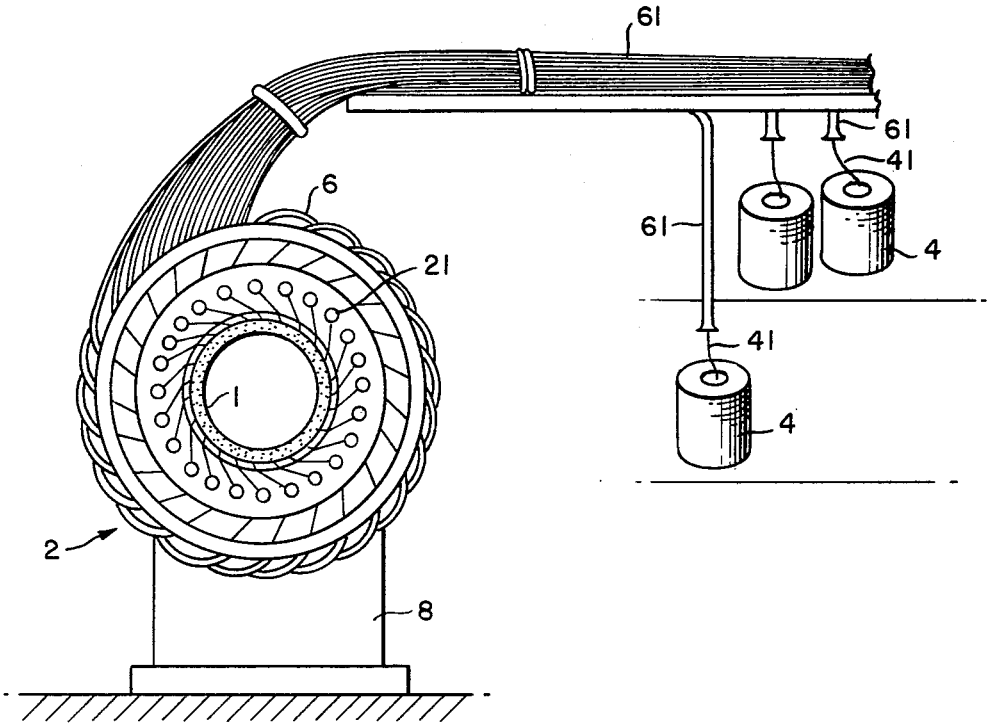
FIG. 12 is a side view showing the linear material guide mechanism.

A linear material guide mechanism is shown in FIG. 12. A characteristic feature of the present invention resides in that the rotating elements can be formed light in weight and small in size, thereby making it possible to wind a number of linear materials simultaneously around the core bar 1. In this case, as shown in FIG. 12, the reels 4 having the linear materials 41 wound therearound are arranged together at one place and the linear materials 41 payed out from the reels 4 are directed through respective guide pipes 61 to the respective guides 6 provided in the support frame 8. By this arrangement, it is made possible to make efficient use of the limited space and to guide a number of the linear materials surely and without confusion.

INDUSTRIAL APPLICABILITY

The winding method and apparatus according to the present invention achieve the most noticeable effects when applied particularly to a continuous production line of reinforced synthetic resin articles such as pipe, plate, rod and the like.

I claim:

1. A winding method comprising the steps of:

inserting a core bar through a winding drum and a winding disk for a coaxial and relative movement therewith;

disposing a reel with a linear material wound therearound at a predetermined position;

fixing a leading end of the linear material payed out from said reel at an arbitrary position on said core bar through a guide hole of said winding disk;

rotating said winding disk in a first direction while moving said core bar in a predetermined direction, thereby winding the linear material around said core bar while winding the linear material around said winding drum;

binding, after a predetermined quantity of the linear material has been wound, a terminal end of the winding of the linear material on said core bar to fix it thereon;

rotating, after said binding and fixing, said winding disk in a second direction which is opposite to said first direction while moving said core bar in a predetermined direction, thereby winding the linear material around the core bar while unwinding and rewinding the linear material around the outer peripheral surface of said winding drum;

binding, after a predetermined quantity of the linear material has been wound, the terminal end of the winding of the linear material securely around said core bar; and repeating the winding and secure binding of the linear material around said core bar a predetermined times.

2. A method as set forth in claim 1, characterized in that said winding drum and said winding disk are formed integrally.

3. A method as set forth in claim 1, characterized in that said winding drum is supported fixedly.

4. A method as set forth in claim 1, characterized in that said winding drum and said winding disk are connected relatively rotatably.

5. A winding apparatus comprising:

a reel disposed at a predetermined position and wound therearound with a linear material;

an elongated core bar of a predetermined sectional shape;

a driving mechanism for moving said core bar in the longitudinal direction thereof at a predetermined speed;

a winding disk supported coaxially and relatively movably with said core bar and having at least one guide hole;

a driving mechanism for rotating said winding disk alternately in opposite directions with a predetermined period and at a predetermined speed;

a winding drum disposed upstream of and adjacent to said winding disk with respect to the direction of movement of said core bar and supported coaxially and relatively movably with said core bar; and a binder disposed downstream of and adjacent to said winding disk with respect to the direction of said core bar, for securely binding the outer periphery of said core bar by other linear material with a predetermined period.

6. An apparatus as set forth in claim 5, characterized in that said winding drum and said winding disk are formed integrally.

7. An apparatus as set forth in claim 5, characterized in that said winding drum is supported fixedly.

8. An apparatus as set forth in claim 5, characterized in that said winding drum and said winding disk are connected relatively rotatably.

9. An apparatus as set forth in any of claims 5 to 8, characterized in that a roller is mounted rotatably on the outer peripheral surface of said winding drum.

* * * * *